US012156590B1

(12) United States Patent
Plasha

(10) Patent No.: US 12,156,590 B1
(45) Date of Patent: Dec. 3, 2024

(54) LITURGICAL ORGANIZER AND ORDO STAND, AN INFORMATION CENTER AND HOLDER FOR LITURGICAL BOOKS AND MATERIALS

(71) Applicant: Christopher Brian Plasha, Pocono Lake, PA (US)

(72) Inventor: Christopher Brian Plasha, Pocono Lake, PA (US)

( * ) Notice: Subject to any disclaimer, the term of this patent is extended or adjusted under 35 U.S.C. 154(b) by 0 days.

(21) Appl. No.: 18/121,742

(22) Filed: Mar. 15, 2023

(51) Int. Cl.
*A47B 97/04* (2006.01)
*A47B 23/04* (2006.01)

(52) U.S. Cl.
CPC .... *A47B 23/042* (2013.01); *A47B 2220/0016* (2013.01)

(58) Field of Classification Search
CPC ..... A47B 23/042; A47B 2220/0016
See application file for complete search history.

(56) References Cited

U.S. PATENT DOCUMENTS 4,685,647 A * 8/1987 Calhoun ..... A47B 23/042 248/444.1
4,712,760 A * 12/1987 Winter ..... A47B 23/06 248/473
5,331,757 A * 7/1994 Ernest ..... G09F 15/0012 40/607.1
5,625,969 A * 5/1997 Vogler ..... G09F 15/0012 40/611.12
D410,686 S * 6/1999 Wear ..... D6/683
6,267,346 B1 * 7/2001 Dill ..... G09F 1/14 248/473
7,228,654 B2 * 6/2007 Stravitz ..... G09F 1/14 40/781
D580,991 S * 11/2008 Smith ..... D19/91
8,371,455 B2 * 2/2013 Kim ..... G09F 1/14 211/49.1
11,460,147 B2 * 10/2022 You ..... F16M 11/16
D989,863 S * 6/2023 Chiang ..... D19/91
2002/0171021 A1 * 11/2002 Goretti ..... A47B 23/042 248/455
2010/0282924 A1 * 11/2010 Boies ..... G09F 1/10 248/176.1

* cited by examiner

*Primary Examiner* — Amy J. Sterling
(74) *Attorney, Agent, or Firm* — Bonini IP Law, LLC; Frank J. Bonini, Jr.

(57) ABSTRACT

An organizer for materials including liturgical materials, and in particular for an Ordo, the organizer having a base, a back, and a front panel, the back and front panel being angularly disposed in rearward positions relative to the base to define a space between the front panel and back, the front panel being made from transparent material. The item held between the front panel and back is supported on the base. The transparency of the front panel allows the text or contents of a book or other material to be read through the panel. The base includes grooves configured to receive the edges of the first panel and back. The base includes a support area in front of the front panel for holding an item. The holder device may be provided to be assembled and disassembled by insertion and removal of the panel and back in the respective grooves.

21 Claims, 5 Drawing Sheets

LITURGICAL ORGANIZER AND ORDO STAND, AN INFORMATION CENTER AND HOLDER FOR LITURGICAL BOOKS AND MATERIALS

BACKGROUND OF THE INVENTION

1. Field of the Invention

The invention relates to the field of holders and organizers for a paper book, forms (such as documents for rites, rituals, services, ceremonies and sacraments, and more particularly for a liturgical materials, such as a religious book, or Ordo, which is used to provide information for masses that take place daily, including parishes or dioceses, churches, chapels, convents, rectory offices and other locations, and the prayers of the priest in "The Divine Office".

2. Brief Description of the Related Art

The Ordo is the small book published in paper form, for the Catholic church liturgical year, advent, Christmas, ordinary time, lent, or Easter, which provides daily information about the masses. The Ordo typically includes information such as the prayers and readings, and options, colors of vestments for the celebrant, as well as the types of masses that may be permitted to be said on each day (as some days may prohibit a funeral or wedding, or other sacrament from). The Ordo includes a number of codes that are provided which are used to stand for abbreviations that indicate what needs to be prepared for the day's liturgy in the sacramentary, lectionary ritual books (mass) and the liturgy of the hours, divine office (e.g., daily prayers).

For example, the Ordo may provide a code, such as "V", which may indicate that the priest may celebrate a votive Mass for a particular need or occasion. Other indications for other types of masses also may be included, such as, for example, the code "R" may appear alone or with one or more other codes, where "R" indicates that the priest is permitted to celebrate a funeral Mass, Requiem, or a Mass for the deceased. The Ordo also provides an indication of the vestment color for a priest saying mass on that day, and may indicate the color with a code, such as, for example, (Gr) to indicate green vestments are to be worn. The Ordo also provides options for a priest, and contains the potential listing of prayers that the priest may use. Some prayers are designated for the particular day, while for some other prayers on the same day, the Ordo may provide the priest with some options and recommendations. Typically, the Ordo is created for the diocese which is a region where a centralized church authority determines the practices and prayers for that diocese, region or province. The Ordo also may contain some information about a particular feast day for a saint (if the day happens to be a feast day for a saint), so the priest may review that prior to saying the daily mass. The Ordo typically contains a suitable number of pages to provide the designated readings as well as codes or instructions for the types of liturgy or mass that may be said on a particular day, as well as other information that the priest or celebrant of the mass may use for the daily mass.

Typically, the Ordo is maintained in a private location within the Church building, and is usually is kept within the Church sacristy for use by the priest or sacristan. The sacristy is a private space in or adjoining the church building and is where the priest prepares and keeps items for mass. A priest may have his own Ordo and may annotate it, or may keep cards or other information near it for use with a particular mass. Typically, the Ordo is kept by the priest in the sacristy, but also the priest may have one or more Ordos in another location such as an office or rectory, or a private room. The priest uses the Ordo to prepare for mass, and may refer to the Ordo to mark prayers and readings from other books that the priest will use during the mass. For example, the Ordo typically indicates which prayers a priest will use during the mass, and may provide which options there are for certain prayers. The Roman Missal is a large, heavy book that contains the words for the mass, as well as prayers and actions that the priest may use or perform during the mass. The Ordo also indicates which readings in the lectionary are to be used by the priest for the mass. The readings are typically contained in the lectionary (which is a large book), the Book of the Gospel, and/or other ritual books, and are referenced in the Ordo. A priest may use the Ordo to mark the pages for the readings in one of the other books for that day's mass (with a ribbon or other suitable mark). For example, the priest may mark readings in the lectionary book based on the designation indicated in the Ordo.

Because it is used daily, the Ordo typically is folded to expose the page or pages for that particular day. Typically, priests have come to use clips, such as binder clips to hold the Ordo pages open, and in some cases, clip the ends, or the top to a stand or other item or post-it-notes or tabs. Often, this can be bulky, and have uneven sides when there are few pages on the left side (at the beginning of a year or liturgical year), and many on the right, and this changes as the liturgical year passes. These prior items are inadequate, including stands, and the Ordo and materials may slide off, or without additional bands or clips to hold a page position open, may flip or change pages.

A need exists for a better way to hold an Ordo so it may be read, and so that it may be readily and easily presented for use for each day.

SUMMARY OF THE INVENTION

A device for organizing liturgical information and materials and holding an Ordo is provided. The term "Liturgy" comes from Greek, and is a public work done on behalf of or for the people. The device is used for, or to facilitate liturgical functions, and is designed to gather and organize the Prayers, readings, physical setup and the mass intention (The name of the deceased for whom the mass is said, and record of the celebrant (who said the mass) for each service/event. The device is a holder or stand for the Ordo book, the book that provides the schedule and/or calendar of the mass (Roman Missal) and the prayers (Liturgy of the Hours LOH) for a priest and community. The device is also holder for other sacramental or ritual forms. The device also designed to facilitate providing messages. Examples include showing the "Way"—including indicia (words or graphics) of a religious figure (e.g., a patron saint), a motto of the priest and/or community, or an advertisement, such as an advertisement for a sacred purpose (e.g., a product, pilgrimage that is meant to guide a particular community in their religion, e.g., Way of Christ). The device is configured as a liturgical organizer, Ordo stand, and holder for liturgical books and materials.

Embodiments of the device provide a holder for a paper book and in particular a holder designed for a specially configured book, referred to as an Ordo, that is used daily for masses, as a code and key to provide the designated readings and information for a mass (also referred to as the liturgy). According to preferred embodiments, features of the device also provide space for organizing other liturgical materials, such as a card (for intentions for a mass, ritual, rite or ceremony), holders for writing instruments and/or magnifiers, as well as for certificates, such as for a baptismal or marriage or funeral certificate (that may be associated with a ceremony). The organizing device may include a plurality of zones that provide areas for holding respective materials. For example, a first zone may be provided to hold a book, such as the Ordo, while a second zone provides an area for holding a document (such as for example, a form for a specific service or mass that is not designated by the Ordo), or other document that may be used when the Ordo is not needed. Additionally or alternatively, the second zone may be used for holding a magnifier or other aid. Another zone may be provided for a card or other document, so that the Ordo may be held in a first zone, as well as a document and/or other item (such as a magnifier) held in the second zone, while a card or other document is held in the third zone. The device 110 provides for the organization of different materials, and, according to preferred embodiments is configured for organizing liturgical materials as shown in the exemplary embodiments.

According to a preferred embodiment, the holder includes a base and a back. The back upstands from the base, and preferably, is angled rearward relative to the base. A front panel is provided and is spaced apart from the back to provide a space between the front panel and the back that is configured to accommodate an Ordo. The front panel preferably is transparent so that while it holds the Ordo in place, the Ordo may be read.

According to preferred embodiments, the holder is configured to hold the Ordo, and includes one or more receptacles for holding a writing instrument, such as a pen or pencil.

According to some embodiments, the holder is constructed so that the front panel may be installed on the base, and preferably by inserting it into the base. According to some preferred embodiments, the base includes a groove that is spaced part from the location of the back, and is designed to receive the lower edge of the front panel therein. The groove also may be angled, and preferably, the angle is similar to the base, or, according to some other embodiments, slightly larger. The angled front panel provides spacing between the front panel and back, when the front panel is installed, so that the Ordo can be accommodated in the space and held for use.

According to preferred embodiments, the holder is configured so that the width of the base supports the Ordo and is at least as wide as the Ordo when the Ordo is held in an open condition (with two pages facing open). Embodiments also are configured so that the base is wider than the Ordo, and provides some additional spacing to hold one or more other items, such as a prayer card (e.g., that the priest says before celebrating a mass, or entering the main Church area), or other items, such as sacrament rites, rituals, services, prayers, records, and the like.

The holder also may be configured so that it is assemblable. For example, the base may be provided separate from the back and the front panel, and the back and front panel may be connected to the base to form the holder. The base may be formed from a single component, or may be formed from a plurality of components, such as a horizontal portion that the back and front panel attach to, which and a supporting portion that extends rearward from the horizontal portion. The base may be constructed to have a suitable weight to support the Ordo. Embodiments of the holder or base may include a rearward extension for additional support.

According to a preferred embodiment, the holder is constructed from three pieces, which preferably include a base, a back and a transparent front panel, and is assemblable and disassemblable by connecting the front panel and back, respectively to the base. According to a preferred configuration, the front panel and back are connectable and detachable from the base by sliding the respective front panel and back into respective grooves in the base.

The device may further include a front facing that may be provided as part of the base, or according to some preferred embodiments, may be removably attachable to and detachable from the base, so that the device and/or facing can be customized with indicia, such as for example, a name, motto, graphic, inscription, advertisement, or combinations of these. The detachable facing may be reversible so that one side is different than the other side, providing options for use. In addition, the facing may be replaced with another facing with different indicia to provide further customization or variations that the user or other provider of the device desires.

According to preferred embodiments, the invention comprises a holder for a book, and in particular for an Ordo, the holder having a base, a back, and a front panel, the back and front panel being angularly disposed in rearward positions relative to the base to define a space between the front panel and back, the front panel being made from transparent material. The book or Ordo is held between the front panel and back and is supported on the base, and particularly the portion of the base upper surface that lies between the front panel and back. The transparency of the front panel allows the book text and/or other contents to be read through the front panel. The base includes two rows of grooves, which are preferably parallel grooves, each groove being configured to receive the edge of the respective front panel or back. The base also may include a support area in front of the front panel for holding an item in addition to the space behind the front panel that holds the book or Ordo. The holder device may be provided to be assembled and disassembled by insertion and removal of the front panel and back into and out from the respective grooves.

These and other advantages are provided by the invention.

BRIEF DESCRIPTION OF THE DRAWING FIGURES

DETAILED DESCRIPTION OF THE PREFERRED EMBODIMENTS

Figure 2:
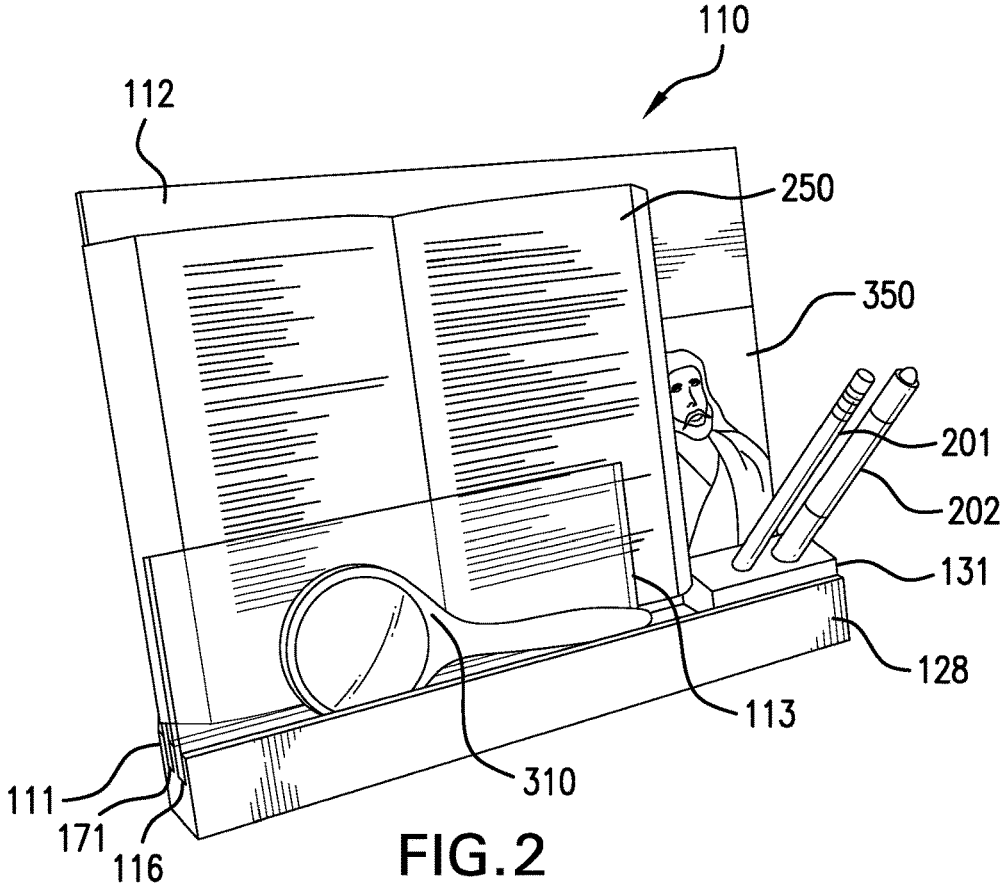
FIG. 2 is another perspective view of the holder of FIG. 1, shown with an Ordo, two writing instruments and a magnifier.

Referring to the figures, a holder 110 is shown and is configured for organizing and holding materials such as, for example, books, forms, and other items. The device 110 is configured to organize and hold liturgical materials, such as books, documents, and forms, as well as other items use in association therewith (pen, pencil, magnifier). According to a preferred embodiment, the device 110 is shown configured as a holder and organizer for holding an Ordo. According to the preferred embodiment shown, the holder 110 has a base 111, a back 112 and a front panel 113. The front panel 113 is transparent, and preferably is made from a clear material, such as, for example, polycarbonate, acrylics, such as polymethyl methacrylates, and other suitable materials. As shown in FIG. 2, the front panel 113 holds the Ordo 250 in place and also allows the Ordo 250 to be read and viewed while held. The front panel 113 also does not intrude, and because there is a need to view information, including codes of one or a few letters, as well as numbers for chapters and verses, the configuration permits the entire view of the Ordo pages to be read. The front panel 113 preferably is secured at a location on the base that is out of the way of the Ordo content, and in the embodiment illustrated is via a groove 116 formed in the base 111.

Figure 3A:
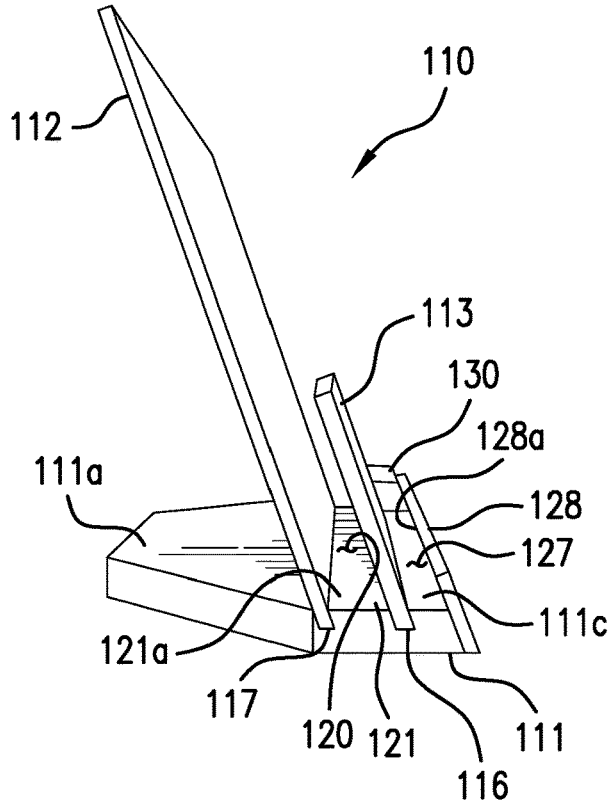
FIG. 3A is a perspective view of the holder of FIG. 1 as viewed from the right of the device.
Figure 3B:
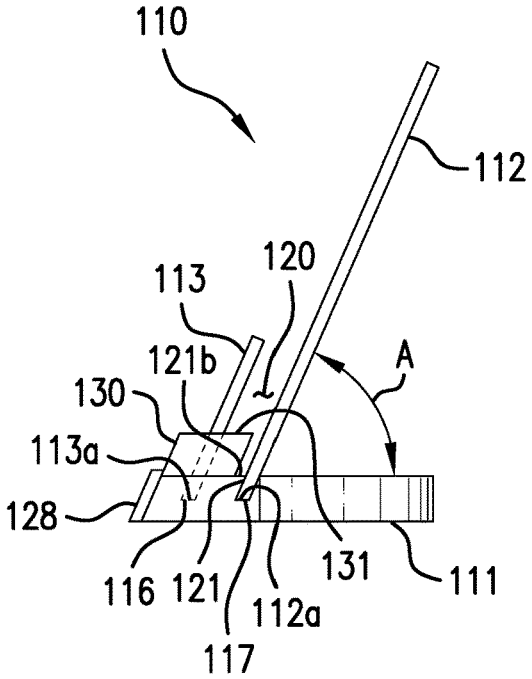
FIG. 3B is a side view of the holder of FIG. 1, as viewed from the left of the device.
Figure 4:
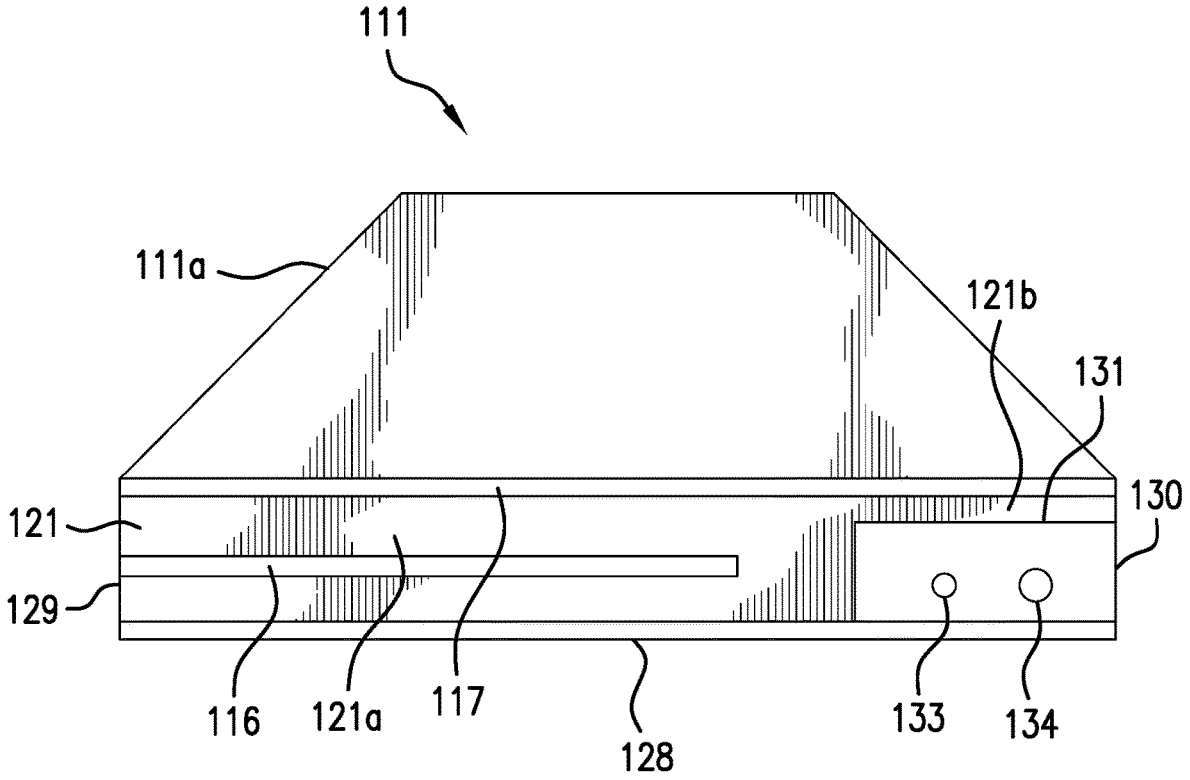
FIG. 4 is a top plan view of the base of the holder of FIG. 1, shown separately from the other components.

Referring to FIG. 4, the base 111 is shown separately and includes a first groove 116 which is in the front, and a second grove 117 which is rearward of the front groove 116. Preferably, the grooves 116, 117 are angled to hold the respective front panel 113 and back 112 in angled or tilted positions when installed on the base 111. The front panel 113 is shown angled relative to the base 111, and the back 112 also is angled. In the embodiment illustrated, the holder 110 includes a space 120 that is a holding space designed to accommodate the Ordo and hold the Ordo between the front panel 113 and back 112. The base 111 includes a floor or lower support 121 which is defined between the intersections of the front panel 113 and back 112 with the base 111 (see FIG. 3). The floor 121 includes a first portion 121*a* that provides a surface on which to rest the Ordo. The holding space 120 is shown defined by the front panel 113 and back 112, and, in the illustrated embodiment, the space 120 has an even depth D, with the front panel 113 and back being tilted at the same angle (angle A). According to preferred embodiments, the angle "A" may be from about 22 degrees to 32 degrees, and preferably is made to be an angle of about 22 degrees, or about 32 decrees. For example, for use of device on a desk, an angle of about 22 degrees may be more suitable, whereas, for a counter, an angle of about 32 degrees may be better suitable. Preferably, the angle "A" is matched so both the back 112 and front panel 113 lean to the same degree. The angle "A" is provided so that the device 110 may be useful when placed on a counter, desk, table or altar having a different height, and the angle is designed to tilt the materials held by the device 110, such as the Ordo 250 as well as other materials, e.g., a card 350, so they may be readily viewed by the user. The floor 121 of the device 110, according to preferred embodiments, also includes an extended or second portion 121*b* that is designed to hold other materials, such as for example, a prayer card, and/or documents for rites, rituals, services, ceremonies and sacraments. See for example, the prayer card 350 in FIG. 2. According to some embodiments, the extended portion 121*b* may comprise a third zone or third holding zone 210, with the first holding area or zone 200 provided as a location for the Ordo 250, the second holding zone 127 provided for additional articles such as a magnifier 310 (and/or other notes, cards or the like), and the third holding zone 210 being used for example, for a card, certificate, record or other document. According to some implementations, the space or zone 210 may utilize the portion of the back 112 to attach a prayer card or picture thereon (which preferably can be viewed and visible even when the Ordo is being held open as shown in FIG. 2).

According to preferred embodiments the device 110 is constructed having a suitable weight so that the base 111 supports the structures, such as the back 112 and front panel 113, as well as an Ordo placed on the device 110. According to some embodiments, the base 111 may include a rear flange 111*a* that extends rearward (behind the location of the back 112) to provide support. The flange 111*a*, also allows for positioning of the device 110 into a corner area or location, and allows the device 110 to be supported by adjacent walls or structures (not shown) against which the edges of the flange 111*a* may engage. For example, the device 110 may be placed on a table or other surface, and the flange may engage walls forming a corner adjacent to where the table or surface is located. The larger footprint of the base 111 may further provide stability. The flange 111*a* also acts as a stop or guard to prevent the device 110 and the back 112 from being damaged if moved toward a structure such as a wall. The rear flange 111*a* may be provided to engage a wall or other structure before the back 112 does. According to some alternate embodiments, the base 111 may be configured without the flange 111, and made of a suitable weight to support the components and Ordo held thereon.

According to the preferred embodiment, the base also may be configured to span beyond the width of the Ordo (when the Ordo width is two open pages), and provide an additional area that includes one or more receptacles for writing instruments, such as pens or pencils, as well as an area where a card or other documents, sheets, notes, records, certificates and the like, also may be stood up or held. The floor extended portion or second portion 121*b* provides a support for the space between the back 112 and another structure, such as for example, the receptacle 131, so that materials other than the Ordo, such as, for example, other documents (e.g., card, sheets, notes, records, certificated and the like) may be supported and held on the device 110. The embodiment illustrated includes a receptacle 130 shown comprising a structure 131 having bores 133, 134 therein for holding a writing instrument (such as a pen or pencil not shown). Although the receptacle structure 131 is shown having two bores 133, 134, the receptacle structure 131 may include other arrangements of bores, such as a single bore, or a plurality of bores. As shown in FIG. 2, writing instruments 201, 202 are held in the respective bores 133, 134 for easy access. The receptacle 130 is shown provided at a location that does not interfere with the placement of the Ordo. In the embodiment of the device 110 illustrated, the receptacle is provided at the end of the device 110 opposite where the Ordo is held. The receptacle 130 preferably comprises a structure 131 that also is situated at a distance from the edge and having a height that further facilitates holding the Ordo against being passed through the space 120. The bores 133, 134 may be provided having the same or different diameters, for example where a larger diameter bore is used for accommodating pens 202, and a smaller diameter bore for holding a pencil 201 (e.g., or thinner or thicker writing instruments).

Although the groove 116 is shown terminating before reaching the receptacle, according to some alternate embodiments, the groove 116 may extend to the receptacle 130.

Figure 1:
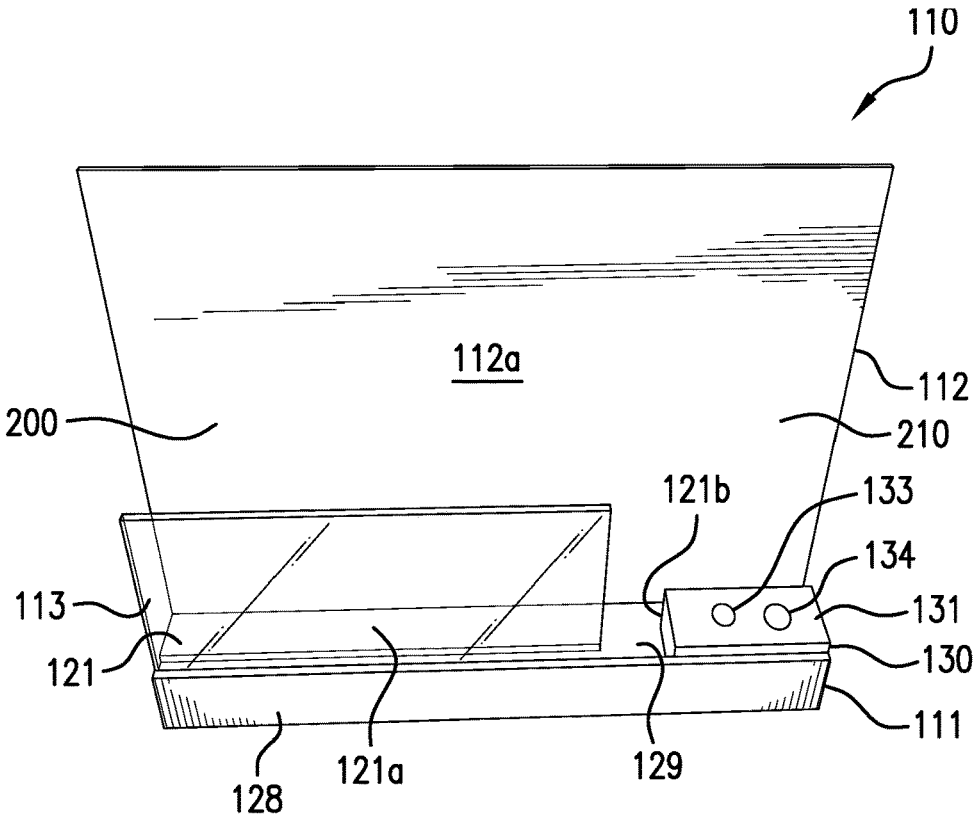
FIG. 1 is a perspective view of an embodiment of a holder according to my invention, as viewed from the front.

According to preferred embodiments, the front panel 113 is situated rearward from the front of the device 110. As shown according to a preferred embodiment, and best seen in FIG. 3A, the front facing 128 has an extended portion 128*a* that is disposed higher than the thickness of the base 111 or base portion where the grooves 116, 117 and floor or lower support 121 are formed. The front facing 128 via the extended portion 128*a* together with the front panel 113 and upper surface 111*c* of the base 111, forms a front holding space, which is a second holding space 127 (in front of the Ordo holding space 120) that is designed to hold an article, or notes, a sacramental form, or other materials. According to some embodiments, the second holding space 127 may comprise a magnifier holder area and is configured to hold a magnifier 310 (FIG. 2). Alternatively, or in addition, notes, a sacramental form, or other materials may be placed in the second or front holding space 127, for temporary placement, in the event the Ordo text at that location needs to be viewed. There are situations where the Ordo does not contain the mass directives or instructions, or other information needed. For example, in some other instances, where a form is used instead of the Ordo, such as for example, in a wedding or other ceremony, then the form or document may be placed in front of the Ordo and supported in the front holding space 127 (while the Ordo can remain in the holding space 120). The magnifier 310 may be used to facilitate reading of the Ordo 250 or other forms held in the device 110. The stand, also as shown in FIG. 2, may include an additional holding area or zone 210 for holding material, such as notes, a card or other materials. As shown in FIG. 1, a main zone or holding area 200 is configured to hold the Ordo 250, and an extended holding area 210 or zone is provided to hold other material such as a card, or note or other records, e.g., for rituals, sacraments, ceremonies, and rites. In FIG. 2, the device 110 is shown in use with the Ordo 250 positioned in the main zone or holding area 200 and a card 350 in the extended zone or holding area 210.

The front panel 113 is shown comprising a transparent material through which the printed text of the Ordo may be read. According to an alternate embodiment, the front panel 113 may comprise a magnification panel.

According to some preferred embodiments, the device 110 may be dimensioned to provide capabilities for holding the Ordo, as well as allow for placement of other items nearby, such as items that may be used in conjunction with the Ordo. The device 110 is designed to eliminate the need for clips and to make it easier to use the Ordo and related items, such as cards, notes, prayers, and certificates or other documents that may be used or required for a particular mass or ceremony (including for example, a service, rite or ritual). In the illustration depicted in FIG. 3, the stand 110 is shown having a facing 128 on which a message, personalization or other indicia may be placed. A message, graphic and/or other indicia also may be placed on the back 112, and preferably may be provided at the top of the back 112 facing forward so that it may be viewed. Preferably, the facing 128 is provided attached to the base 111, or the base may be provided comprising the front facing 128. The facing 128 is shown as a separate component, but may be provided as part of the base 111 or, alternatively, may be provided separate therefrom, and according to embodiments, the front panel 113 and back 112 may be removable, while the facing remains attached and is non-removable. According to some alternate embodiments, the facing is removable and/or may be assembled together, using any suitable attachment means, such as for example, screws, adhesive, magnets, pins, posts or the like. For example, the facing may include indicia, such as a message, text and/or graphic, an advertisement, or personalization, and can be removably attached and detached from the base 111. The facing 128 may have different indicia or no indicia on each side. Examples include a name of a church or priest, a promotional indicia (e.g., where the device is provided as a gift).

According to some preferred embodiments, the device 110 is constructed having preferred dimensions. For example, according to one preferred dimensional configuration, the dimensions are the span between the front panel 113 and back 112 is about ¾" spacing, which also defines the width of the channel or space 120 in the preferred embodiment. In the embodiment illustrated, the grooves 116, 117 are provided having a suitable depth to receive the respective front panel 113 and back 112 and secure it on the base 111. According to a preferred embodiment, the back may formed from a panel that is about 8" inches by 11¾ inches, and the front panel 113 may be about 3 inches by about 8 to 8¾ inches, or may be higher than 3". The panel 113 may be higher than 3", and, according to some embodiments, can be as tall or high as the height of the back 112. According to some embodiments, where the groove 116 extends to the receptacle 130, the front panel width may be of a suitable width to abut the proximal edge of the receptacle 130. Alternatively, according to some other embodiments, the front panel 113 may be provided having a width that is shorter than the length of the grove 116.

For example, according to some alternate embodiments, where the panel 113 comprises a magnification panel, then it may be higher to provide more coverage for the text of the Ordo. Also, where a separate reader viewer is provided to be moved along the panel 113, then the panel 113 may also be suitably higher to allow for the reader viewer to reach the top of the Ordo (to magnify text at the top of the Ordo pages). The thickness of the front panel 113 and back 112 may be about ¼ inch. Preferably, the respective grooves 116, 117 are sized similarly or slightly larger to accommodate and securely hold the respective front panel 113 and back 112.

The device 110 is shown according to a preferred embodiment with a front facing 128, which preferably is disposed on the front of the base 111 and show covering the front of the base 111. The front facing 128 may be provided as part of the base 111, or alternatively, may be separately provided, and may be attached to and/or removed from the base 111, to provide graphics or indicia, such as personalization, messages, and/or even sponsorships or advertising (e.g., donor name or organization), as well as to permit changing thereof by changing them on the front facing 128 or providing a different facing 128. The front facing may be removably detachable, and may be reversible. For example, the front facing may be attached with adhesive or glue, pins or screws. The front ledge 129 of the base 111 is shown comprising the floor 120 and grooves 116, 117, and is provided having a suitable width to hold the back 112 and front panel 113, and provide space for the Ordo 250 (see FIG. 2). According to a preferred configuration, the front ledge 129 of the base 111 may be about 1¾ inches. The front ledge 129 is shown joining with the rear flange 111*a* in the embodiment illustrated.

Figure 5:
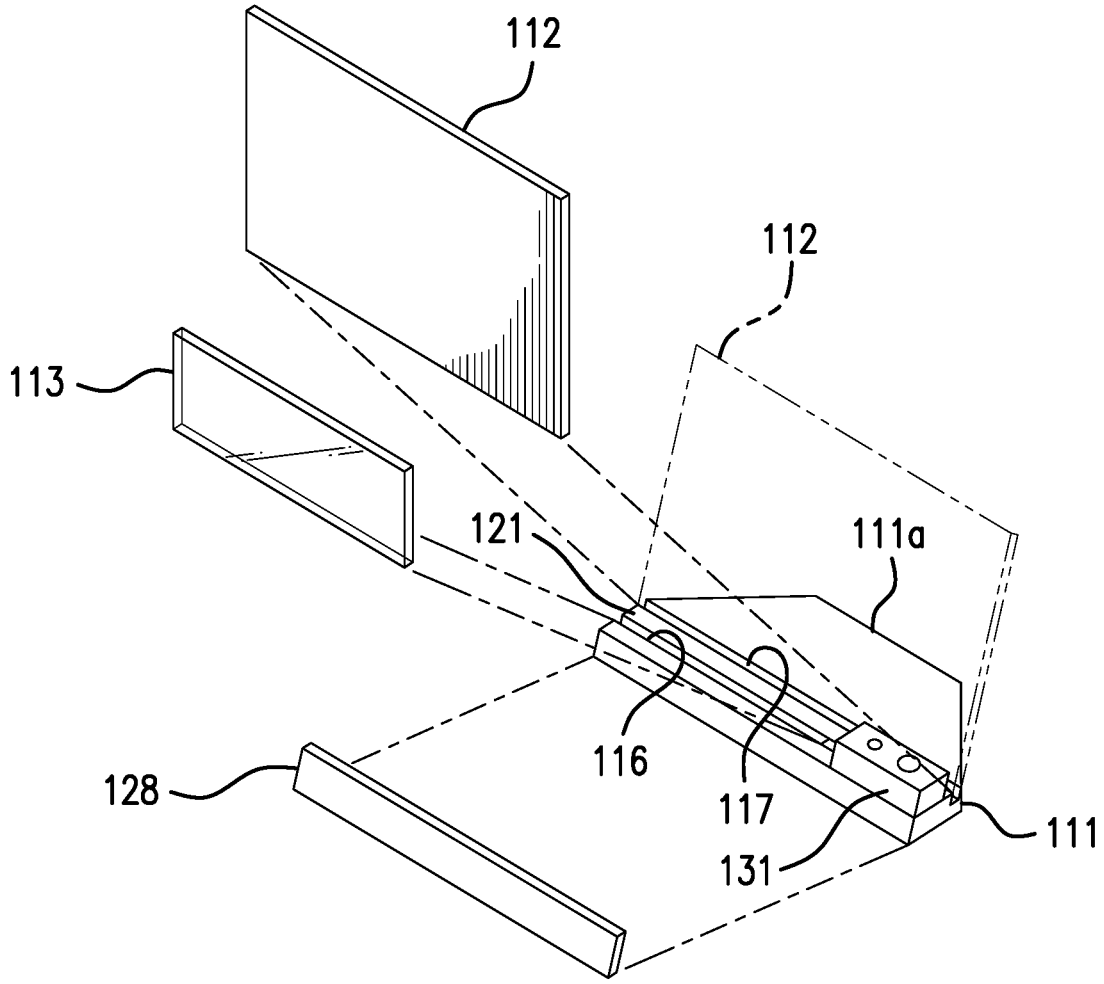
FIG. 5 is an exploded view of the holder of FIG. 1 showing the back and front panel separated from the base, and with the front facing detached from the base.
Figure 6:
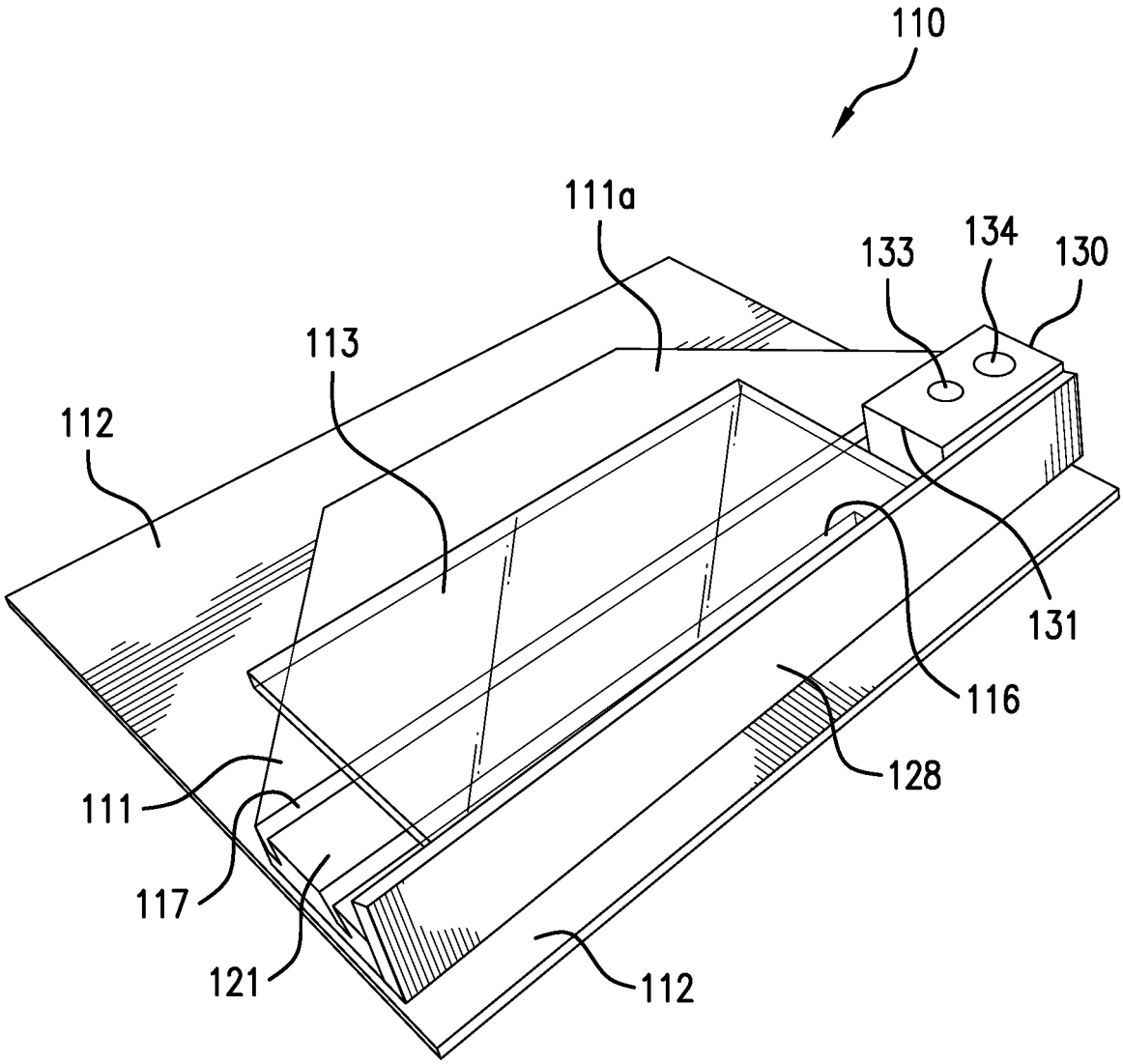
FIG. 6 is a perspective view of the holder of FIG. 1 shown in a collapsed condition with the components disassembled.

The facing 128 can be customized with indicia, such as for example, a name, motto, graphic, inscription, advertisement, or combinations of these. The facing 128, when provided as a detachable facing, may be reversible so that one side is different than the other side, providing options for use. The facing 128 may be removed from the base 111 and replaced with another facing 128 with different indicia, graphics, texts, colors or other variations. The devices according to the invention may be configured where the device components are attached together, or alternately some or all of the components may be removably attachable and detachable. According to some preferred embodiments, the front panel 113 and back 112 may be separate components that can be installed on the base 111 by inserting them into the respective grooves 116, 117. As shown in FIG. 6, the device 110 is disassembled, and the base 111 is shown resting on the back 112, and the front panel 113 is placed on the base 111. This permits the device 110 to be compact for shipping or storage. Referring to FIG. 5, the base 111, back 112 and front panel 113 are shown in an exploded view showing how the components may be attached and removed during assembly and disassembly.

According to preferred embodiments, the front panel 113 preferably has an angled lower edge 113*a* (FIG. 3B), and the back 112 also may have an angled edge 112*a*. The angled edges 113*a*, 112*a*, preferably are matingly configured to be received within the respective grooves 116, 117, and according to preferred embodiments, the grooves 116, 117 are angled to match the angle of the respective angled edges 113*a*, 112*a*.

While the preferred embodiments are illustrated, the device 110 may be constructed from any suitable materials. Preferably, the front panel 113 is constructed from a clear or transparent material that permits viewing of materials when placed behind the front panel in the device 110. The back 112 is shown having a wood grain finish, and may have other finishes. The back 112 may be constructed from wood, plywood, plastic or other suitable material (including metal). The back 112 may include a design or finish (e.g., a scene, or grain of wood, or a vinyl overlay, or other graphic, texture or color surface). Preferably, the design is provided on the front face 112*a* of the back, although the front face 112*a* and rear face also may each include a suitable graphic, design or finish. Although some preferred dimensions are described, the devices may be produced with different dimensions and sizes, including the tilt angle. For example, where the device is to be used on a surface that is lower in height, or where the user is taller in height, then the angle may be larger to situate the materials, such as the Ordo and/or other materials, at an appropriate angle to facilitate viewing by the individual. Conversely, the angle may be decreased where the surface on which the device is placed is higher or the person is shorter. According to an alternate embodiment the device may be provided with the base and a back panel and front panel where the base width is provided to be about as wide as the Ordo, and where the front panel covers the Ordo, and where the back also is about as wide as the Ordo. In some alternate embodiments, the receptacle is not provided, and the base width is configured to be about the width of the Ordo (when folded opened to show two pages), and the front panel and back are accordingly configured to similar widths. Although the preferred embodiments of the invention are shown and described in conjunction with an Ordo and are configured for organizing, holding and supporting an Ordo and associated materials, such as a card, form, prayer card, magnifier, pens and pencils, the invention may be configured for use with other materials.

What is claimed is:

1. A device for organizing and holding materials comprising:

a) a base having a width;

b) a back;

c) a front panel, wherein the front panel is transparent and has a width;

d) wherein the back is supported by the base;

e) wherein the front panel is supported by the base;

f) wherein the back is angled rearward of the front panel, and wherein the front panel is angled rearward toward the back;

g) wherein the front panel and the back are spaced apart from each other to define a holding space;

h) wherein the base width includes a first width portion that supports the front panel and a second width portion that spans beyond the width of the front panel.

2. The device of claim 1, wherein the base includes a first groove, and wherein the front panel includes a lower edge, and wherein said lower edge is supported in the first groove; and wherein the first groove spans partially across the base, and terminates at the base width first portion.

3. The device of claim 2, wherein the first groove is angled.

4. The device of claim 3, wherein said first panel lower edge is angled.

5. The device of claim 4, wherein the angle of the first panel lower edge is matingly configured to fit within the first groove so the first panel is supported in a position where the first panel is rearwardly situated to be angled toward the back.

6. The device of claim 1, wherein the base includes a groove, and wherein the back includes a lower edge, and wherein said lower edge of the back is supported in the groove.

7. The device of claim 6, wherein the groove is angled.

8. The device of claim 7, wherein said lower edge of the back is angled.

9. The device of claim 8, wherein the angle of the lower edge of the back is matingly configured to fit within the groove so the back is supported in a position where the back is angled in a direction rearwardly of the front panel.

10. The device of claim 4, wherein the base includes a second groove, and wherein the back includes a lower edge, and wherein said lower edge of the back is supported in the second groove.

11. The device of claim 10, including a receptacle that has at least one bore therein.

12. The device of claim 1, including a receptacle disposed on or formed in the base that has at least one bore therein.

13. The device of claim 1, wherein said base comprises at least one first supporting surface for supporting an item between said front panel and said back, and wherein the front panel and back holding space therebetween comprises a first holding zone.

14. The device of claim 1, wherein said base includes a front facing and comprises at least one supporting surface for supporting an item between said front panel and said front facing, and wherein the front panel and front facing defining a space therebetween comprising a front holding zone.

15. The device of claim 1, wherein said base comprises at least one first supporting surface and at least one second supporting surface, wherein the at least one first supporting surface is configured to support a first item between said front panel and said back, the front panel and back space therebetween comprises a first holding zone; and wherein the least one second supporting surface is configured to support a second item between said front panel and said front facing, the front panel and front facing defining a space therebetween comprising a second holding zone.

16. The device of claim 10, wherein said holder is assemblable and disassemblable, and wherein said back is slidably installable in said second groove, and wherein said front panel is slidably installable in said first groove.

17. The device of claim 16, wherein said first groove comprises a recess disposed horizontally along the base surface, and wherein said front panel edge is matingly configured to fit within the first groove recess.

18. The device of claim 16, wherein said second groove comprises a recess disposed horizontally along the base surface, and wherein said back edge is matingly configured to fit within the second groove recess.

19. The device of claim 17, wherein said second groove comprises a recess disposed horizontally along the base surface, and wherein said back edge is matingly configured to fit within the second groove recess.

20. A device for organizing and holding liturgical materials that include for an Ordo book comprising:

a) a base;

b) a back;

c) a front panel, wherein the front panel is transparent;

d) wherein the back is supported by the base;

e) wherein the front panel is supported by the base;

f) wherein the back is angled rearward of the front panel, and wherein the front panel is angled rearward toward the back;

g) wherein the base includes an angled first groove, and wherein the front panel includes an angled lower edge, and wherein said angled lower edge is supported in the angled first groove;

h) wherein the angle of the front panel lower edge is matingly configured to fit within the first groove so the front panel is supported in a position where the front panel is rearwardly situated to be angled toward the back;

i) wherein the base includes an angled second groove, and wherein the back includes an angled lower edge, and wherein said angled lower edge of the back is supported in the angled second groove;

j) wherein the angle of the lower edge of the back is matingly configured to fit within the groove so the back is supported in a position where the back is angled in a direction rearwardly of the front panel;

k) a receptacle that has at least one bore therein and being disposed on or formed in the base;

l) A front facing disposed on the front of said base;

m) wherein the base comprises a lower supporting surface for supporting a first item thereon, the lower supporting surface being located between the front panel and the back and their respective engagements with the respective angled first groove and angled second groove; and n) wherein the device holder includes a first zone defining a first space for a first item, and wherein said front panel at least partially covers said first zone, and wherein said device includes a second zone defining a second space for a second item; wherein the first zone is located between the front panel and the back, and wherein the second zone is located between the front panel and the front facing;

o) Wherein the base comprises a supporting surface for the first zone defining the first space for the first item, and for the second zone defining the second space for the second item; and p) the device including a third zone;

q) wherein the base comprises a supporting surface for the third zone;

r) wherein the front panel terminates prior to the third zone; and s) wherein the back provides at least in part a boundary of the third zone.

21. The device of claim 1, wherein the base has a rear flange that extends rearward beyond the back.

* * * * *